US005570863A

United States Patent [19]

Cooper

[11] Patent Number: 5,570,863

[45] Date of Patent: Nov. 5, 1996

[54] DRINK HOLDER

[75] Inventor: Sandy Cooper, New York, N.Y.

[73] Assignee: Sun It Corp., Mt. Vernon, N.Y.

[21] Appl. No.: 332,896

[22] Filed: Nov. 1, 1994

[51] Int. Cl.[6] ..... A47G 23/02

[52] U.S. Cl. ..... 248/146; 248/156; 248/160

[58] Field of Search ..... 248/146, 156, 248/160, 175, 622, 311.2

[56] References Cited

U.S. PATENT DOCUMENTS

| | | | |
|---|---|---|---|
| D. 308,802 | 6/1990 | Ward | 248/156 X |
| 2,506,321 | 5/1950 | Vosburgh | 248/156 |
| 2,520,818 | 8/1950 | Terry | 248/156 X |
| 3,067,717 | 12/1962 | Imparato | 248/156 X |
| 3,141,644 | 7/1964 | Baird | 248/146 |
| 3,586,274 | 6/1971 | Hart | 248/156 X |
| 4,096,951 | 6/1978 | Menssen | 248/156 X |
| 4,570,275 | 2/1986 | Merriman | 248/175 X |
| 4,582,282 | 4/1986 | Gracie | 248/175 X |

FOREIGN PATENT DOCUMENTS

| | | | |
|---|---|---|---|
| 279132 | 11/1951 | Switzerland | 248/156 |

*Primary Examiner*—Alvin C. Chin-Shue
*Assistant Examiner*—Derek J. Berger
*Attorney, Agent, or Firm*—Stanley J. Yavner

[57] ABSTRACT

A drink container supporting structure, primarily for outdoor use is provided in order to enable the user to support a drink container steadily, for insertion into the ground and for attaching, for instance, to the side arm of a chair. The structure of the drink holder includes basically plastic tubing forming an upper, spiraled liquid container holder, a mid-portion, also of plastic tubing, with a wire threaded therethrough and into a lower portion. The lower portion is also of plastic tubing, with a wire therethrough and the structure terminates at its lowermost end in a pointed configuration for insertion into the ground, to support the entire structure.

1 Claim, 1 Drawing Sheet

DRINK HOLDER

FIELD OF THE INVENTION

This invention relates primarily to patio and backyard utensils, and more particularly to drink container holders for attachment to the arm of a chair or in the ground.

BACKGROUND OF THE INVENTION

Modern living has now developed with the premium on leisure activities, many of which are centered in and around the home. For instance, backyard patios and backyards themselves have replaced the kitchen as the meeting place for family and friends.

In the course of such leisure activity, it has become apparent that the amount of table surfaces necessary for supporting beverage containers for everyone involved in group conversations at any one time on the patio or in the backyard, would exceed what is actually available on the patio or in the backyard. To supplement the table surfaces that are available, it would be convenient to enable the support of beverage containers, while used, in connection with seating structures, or at least near seating structures.

OBJECTS AND SUMMARY OF THE INVENTION

Accordingly, a primary object of the present invention is to provide a drink holder for attachment to an arm chair or for sturdy placement next to a chair or seating surface of any kind.

A further and more particular object is to provide a compact, easily stored, efficient drink holder, which does not require the use of a table surface.

A further and even more particular object of the present invention is to provide a drink holder which maintains a drink container in a stable, yet easily usable orientation.

These and other objects of the present invention are accomplished in a drink holder structure which features an upper portion, a lower portion and a mid-portion. All portions of the structure are formed of tubular structural plastic or the like, with the upper portion having a spiral formed into a cylindrical shape in order to support a beverage container. The lower portion is formed with a pointed lowermost piece for convenient insertion into the ground and for thereby supporting the entire structure of the drink holder, as well as the beverage container supported thereby. The mid-portion is flexible and easily adjusted into various forms for holding the overall drink holder in a stable position. The tubular plastic outer structure of the drink holder has inserted therethrough for most of its extent, a wire, or the like, for ease of changing form for the mid-portion and for general rigidity of the overall structure.

BRIEF DESCRIPTION OF THE DRAWINGS

Other objects and advantages of the present invention become apparent by reference to the following preferred, but nonetheless illustrative, embodiment of the present invention, with reference to the accompanying drawings, wherein.

DETAILED DESCRIPTION OF THE PREFERRED EMBODIMENT

Figure 2:
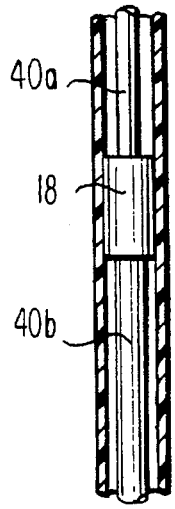
FIG. 2 is a side sectional view taken along the line 2—2 of FIG. 1 and showing particularly the lower part of the upper portion, with wire threaded through the tubular plastic outer structure.
Figure 1:
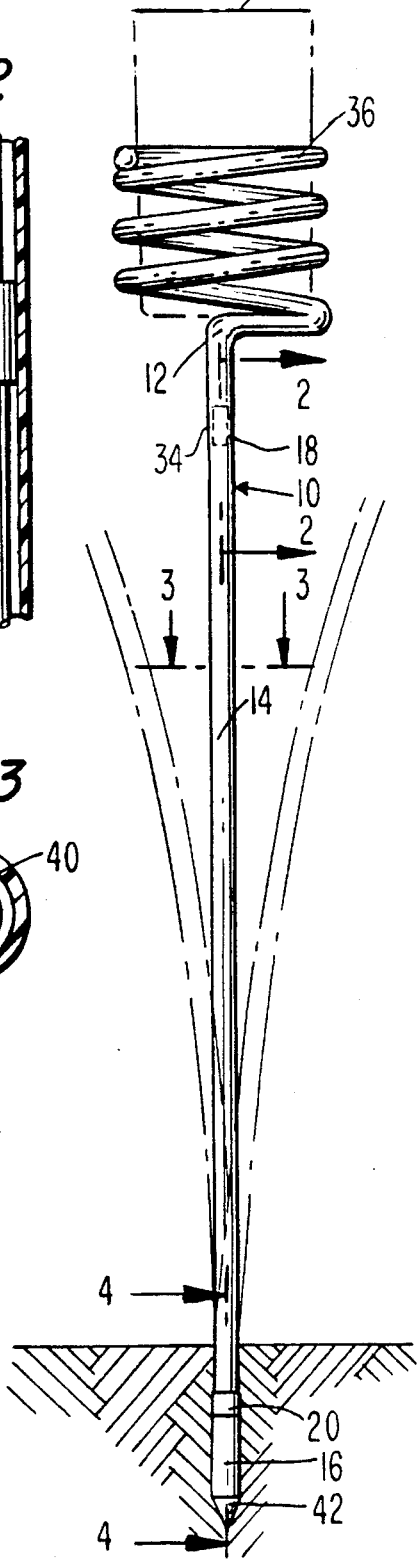
FIG. 1 is a front view of the drink holder structure according to the present invention, showing its insertion to the ground.

According to the present invention, a structure is presented for a drink holder, generally designated 10, which includes an upper portion 12, a mid-portion 14 and a lower portion 16. By use of couplings 18, 20, such as are shown in FIGS. 1, 2 and. 4, the portions may be coupled by couplings 18, 20, as will be particularly described with respect to the joining of the midportion 14 and the lower portion 16 at coupling 20. Coupling 20 is shown particularly in FIG. 4 as including the overfitting of outer plastic tubing 22, of midportion 14, so that it surrounds outer plastic tubing 26 of lower portion 16. Upper part 28 of lower portion 16 is stepped at 32, in order to facilitate the overlapping of the midportion outer sheath, and the fitting thereof. Likewise, step 34 facilitates the same type of structure, with respect to coupling upper portion 12 with midportion 14. Midportion 14 is coupled to upper portion 12, by use of coupling 18 in the same general manner as the other coupling. Alternatively, a break in the outer sheath or tubing 22 is avoided, and coupling 18 avoided, by a boring at the top of greater diameter wire **40*b*, into which is fitted lesser diameter wire 40*a*, which is facilitated by taking advantage of the difference in size of diameter between wire 40*a* threaded through the upper portion and wire 40*b* threaded through the midportion. The lesser diameter wire 40*a* provides more flexibility for encircling a drink cup or container within upper portion 12, and strength is provided by the greater diameter wire 40*b* in the midportion 14 and the lower portion 16 (see FIG. 2**).

Generally, the structure of drink holder 10 includes a spiraled liquid container holder section 36. Such shaping facilitates holding of the form of the container, shown in ghost lines 38.

Figure 3:
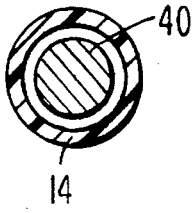
FIG. 3 is a top sectional view taken along the line 3—3 of FIG. 1 through the mid-portion of the structure, and showing particularly the outer tubular concentric plastic elements encircling the wire therethrough in the mid-portion of the overall structure.
Figure 4:
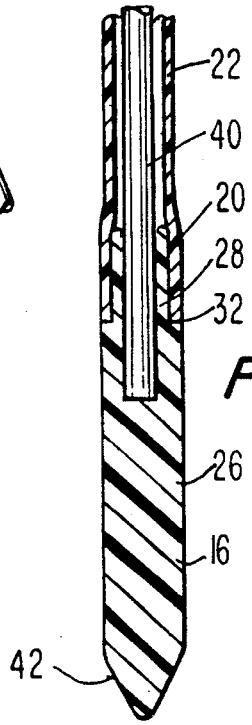
FIG. 4 is a side sectional view taken along the line 4—4 of FIG. 1, and showing particularly the lower part of the mid-portion of the structure and the lower portion thereof.

In more detail, FIGS. 2–4 illustrate the use of wire 40 threading the interior bore of plastic tubing, generally throughout the length of the drink holder, in order to provide strength and 20 general rigidity to the overall structure below the spiral section 36.

It should also be pointed out, as is particularly shown in FIGS. 1 and 4, that the lowermost part of the lower portion is provided with plastic tubing in the shape of a point 42, whereby the entire structure can be supported in a generally uprightly oriented configuration by insertion to the ground, or in sand.

Figure 5:
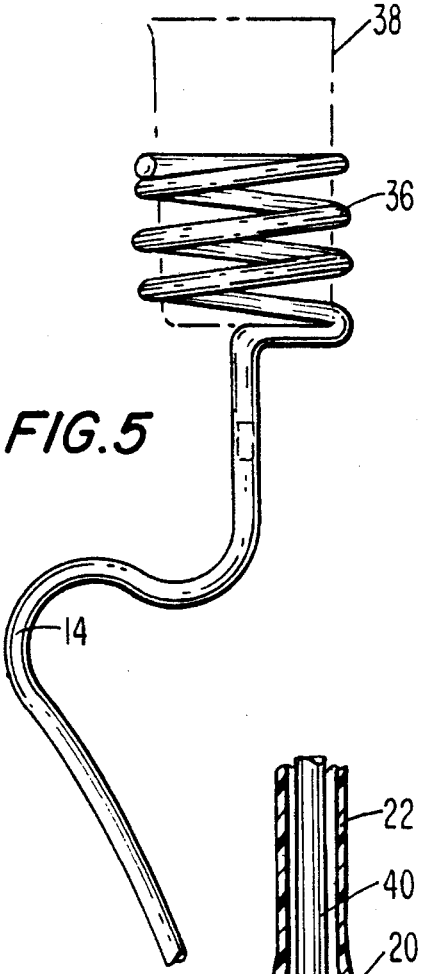
FIG. 5 is a front view of the upper and mid-portions of the drink holder, for use in wrapping the mid-portion around, for instance, the arm of a chair.

Another use of the structure is attained by, for instance, wrapping mid-portion 14 around the arm of a chair, the beginnings of which configuration are shown in FIG. 5. The plastic tubing outer sheath of the present invention, combined with the wire 40 enables a wrapping around the arm of a chair (or around another convenient support) in such a manner that rigidity and strength of the item is maintained, while the upper portion spiral 36 remains in an orientation to support a beverage container, without spilling the contents.

In order to provide a more complete description of the present invention, a series of use and form steps with the structure as described herein, will now be set forth. In terms of beach use, as an example, and presuming that the person using the drink holder, as described herein, is sitting in a beach chair with arms, mid-portion 14 is wrapped around the arm of the chair, so that mid-portion 14 encircles such arm a number of times. Also, the upper part of mid-portion 14 is bent into a vertical orientation, so that beverage container 38 will be oriented vertically to avoid spills.

Assuming then that the person using the beach chair, as just described, is joined by another person, and the other person is offered a beverage, but has no beach chair, such other person's needs are satisfied by placement of point 42 into the available beach sand. The balance of the structure of the drink holder is then made as vertical as possible, and the other person sits in the sand, with his or her beverage container 38 in a vertical orientation, and yet conveniently usable.

Accordingly, a drink holder structure has been described, but the description should not be a limitation of the extent of the invention, which is set forth only by the following claims:

What is claimed is:

1. A drink holder structure comprising an upper portion and a mid-portion, said upper portion coupled to said mid-portion and each having an outer sheath formed from tubular plastic, said upper portion defining a spiral shape to circumscribe a space in the shape of a solid cylinder with its axis vertical and generally continuing the line formed by said mid-portion, wherein most of the extent of said structure includes a cylindrical wire within said tubular outer sheath, said wire being in two parts, an upper part and a lower part, the diameter of said upper part being less than the diameter of said lower part, one of said parts having a bore sufficient in diameter to receive the other of said parts, in order to provide more strength for said mid-portion, and yet more flexibility for said upper portion, said structure also having a lower portion defining, at its lowermost extent, a pointed surface, pointing downwardly of said structure, whereby said characteristics of strength and flexibility enable alternative usages supporting said structure by use of its lower portion, or with its mid-portion wrapped, to mount said upper portion with its axis in a vertical position.

* * * * *